US006761018B2

(12) United States Patent
Balding

(10) Patent No.: US 6,761,018 B2
(45) Date of Patent: Jul. 13, 2004

(54) BIT SYSTEM HAVING SELECTABLY ADJUSTABLE SHANK AND MOUTHPIECE MOVEMENT

(75) Inventor: Tom L. Balding, Sheridan, WY (US)

(73) Assignee: TLB, Inc., Sheridan, WY (US)

( * ) Notice: Subject to any disclaimer, the term of this patent is extended or adjusted under 35 U.S.C. 154(b) by 0 days.

(21) Appl. No.: 10/279,804

(22) Filed: Oct. 23, 2002

(65) Prior Publication Data

US 2003/0074869 A1 Apr. 24, 2003

Related U.S. Application Data

(60) Provisional application No. 60/394,344, filed on Jul. 2, 2002, and provisional application No. 60/336,435, filed on Oct. 24, 2001.

(51) Int. Cl.[7] ..... B68B 1/06
(52) U.S. Cl. ..... 54/8; 54/7
(58) Field of Search ..... 54/7, 8

(56) References Cited

U.S. PATENT DOCUMENTS

| | | | | |
|---|---|---|---|---|
| 529,472 A | * | 11/1894 | Bigelow | 54/7 |
| 1,335,964 A | * | 4/1920 | Hensley | 54/7 |
| 3,527,023 A | * | 9/1970 | Swanson | 54/8 |
| 4,274,246 A | | 6/1981 | Stewart | 54/6 |
| 4,884,390 A | | 12/1989 | Benjak et al. | 54/7 |
| 4,965,987 A | * | 10/1990 | Bork | 54/7 |
| 5,062,255 A | | 11/1991 | Myler et al. | 54/7 |
| D328,657 S | | 8/1992 | Steele | 54/7 |
| 5,822,950 A | | 10/1998 | de Moya et al. | 54/8 |

OTHER PUBLICATIONS

"2000 Spring Catalog," National Roper's Supply, pp 56–67.
"2000–2001 Annual Catalog," SS Schneiders, pp 61–64.
"Bit Mouthpieces," Tom Balding Bits & Spurs webpage, http://www.tombalding.com/front/subpages/bits/mouth-pieces.html, printed Sep. 21, 2001, 4 pages.
"Bit Shanks," Tom Balding Bits & Spurs webpage, http://www.tombalding.com/front/subpages/bits/shanks.html, printed Sep. 21, 2001, 2 pages.
"Equine Bits, Finding the Correct Bit to Use," http://www.geocities.com/Heartland/Ranch/884l/bits.html, printed Sep. 21, 2001, 4 pages.
"How to Choose," John Dewsbury Equine Horse Bits webpage, http://www.horsebit.com/choosing.html, printed Sep. 21, 2001, 3 pages.
"Myler Bits—The Secret's in the System," Circle F Saddles & Tack webpage, http://www.circle.com/myler.html, printed Sep. 21, 2001, 2 pages.
"The Premier Catalog for the Western Horeman," Smith Brothers, 1998, pp H1–H16.

* cited by examiner

*Primary Examiner*—Charles T. Jordan
*Assistant Examiner*—Elizabeth Shaw
(74) *Attorney, Agent, or Firm*—Santangelo Law Offices, P.C.

(57) ABSTRACT

A bit having selectably adjustable rotation about the axis of the shank post and the mouth piece as well as vertical adjustable shank location for use with a variety of animals and mouth pieces.

42 Claims, 17 Drawing Sheets

BIT SYSTEM HAVING SELECTABLY ADJUSTABLE SHANK AND MOUTHPIECE MOVEMENT

BACKGROUND OF THE INVENTION

Generally, a bit system including both apparatus and methods to provide selectably adjustable shank movement relative to the mouth piece of a bit.

During the long history of horsemanship, various devices have been invented to assist the rider in controlling the animal and causing it to move in the desired direction. Refinement of these control devices has resulted in the now familiar tack arrangement of a bridle (1) comprised of straps which adjustably fit around the animal's head (2), a bit (3) which may include shank pieces (4) on either side of a metal mouth piece (5) adapted to fit in the particular animal's mouth and extend over and atop its tongue that is responsive to the shank pieces and a set of reins (6) that are conventionally attached to end rings (7) of the shank pieces (4) at either side of the animal's head.

There are many different kinds of bits for use in riding horses, mules, donkeys, burrows, etc. While certain shank and mouthpiece configurations for bits tend to be somewhat more universal than others, there is still a need to be able to fit the bit and mouthpiece to the particular animal for which it is to be used. Furthermore, during the training process certain bits may be used on a particular animal which may not be necessary once the animal is adequately trained. Consequently, it has been considered to be necessary to have a large number of bits available when many different animals are to be ridden and this array of necessary bits is only magnified if the animals are going through a training process.

Specifically, the bit may also include a shank (4) coupled to either side of the mouth piece (5). Conventionally, riders select either shanks that do not move or are fixed with respect to the mouth piece or select shanks that move or are hingedly responsive with respect to the mouth piece. The shanks can take a variety of configurations depending on the particular animal for which the shank is used or the manner of training.

When animals are being shown, such as at horse shows, more formal and fancy equipment is normally used in order to present the animal at its best. Consequently, it has become customary to use shanks with ornate inlays, such as silver. These bits are naturally more expensive than the ordinary steel bits because of the precious metals needed and the workmanship involved. Because of the high expense of these fancy bits, the problem identified above may be exacerbated.

While conventional bit technology available to the public provides numerous permutations and combinations of the various shanks and various mouth pieces described above, conventional technology has yet to provide a single bit having shanks with selectably adjustable movement relative to the mouth piece.

The invention described herein addresses the above-mentioned problem in a practical fashion.

SUMMARY OF THE INVENTION

Accordingly, the broad object of the invention can be to provide a bit with selectably adjustable shank technology that can be used in a variety of applications.

Another object of the present invention is to provide an improved bit for animals such as horses.

Another object of the invention is to provide a novel bit structure having interchangeable shank members for use with one mouth piece.

A further object of the invention is to eliminate the need for separate bits for different animals or different occasions.

Still another object is to provide a universal bit structure which is economical to manufacture, fast and simple to change, and dependable to use.

Other objects, advantages, and novel feature of the present invention will become apparent from the following detailed description of the invention when considered in conjunction with the accompanying drawings.

DETAILED DESCRIPTION OF THE PREFERRED EMBODIMENTS

The invention involves a bit having shank pieces and mouthpieces that have selectably adjustable travel. While particular examples of the bit invention are provided in the context of horses it should be understood that these examples are intended to be illustrative of the great variety of animals, including but not limited to, horses, mules, donkeys, or the like, with which the bit invention can be used.

Moreover, while specific examples of mechanical hardware or components are shown, these examples are not intended to be limiting with regard to the great variety of hardware or components that can function similarly to the hardware or components illustrated or described and are not intended to limit the description of the invention to the constructs shown.

Figure 1:
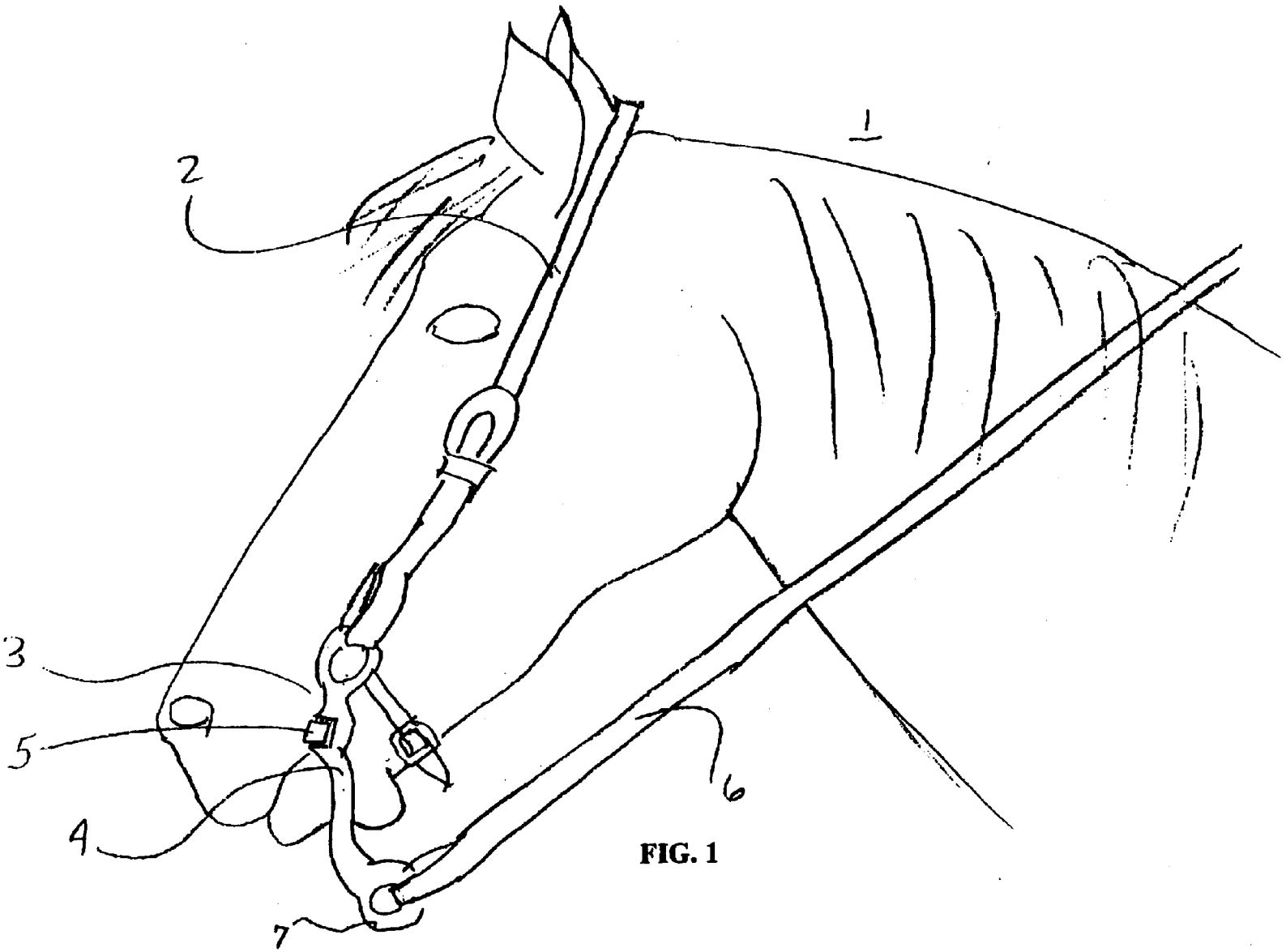
FIG. 1 shows a generalized bridle with bit fitted to a horse.
Figure 2:
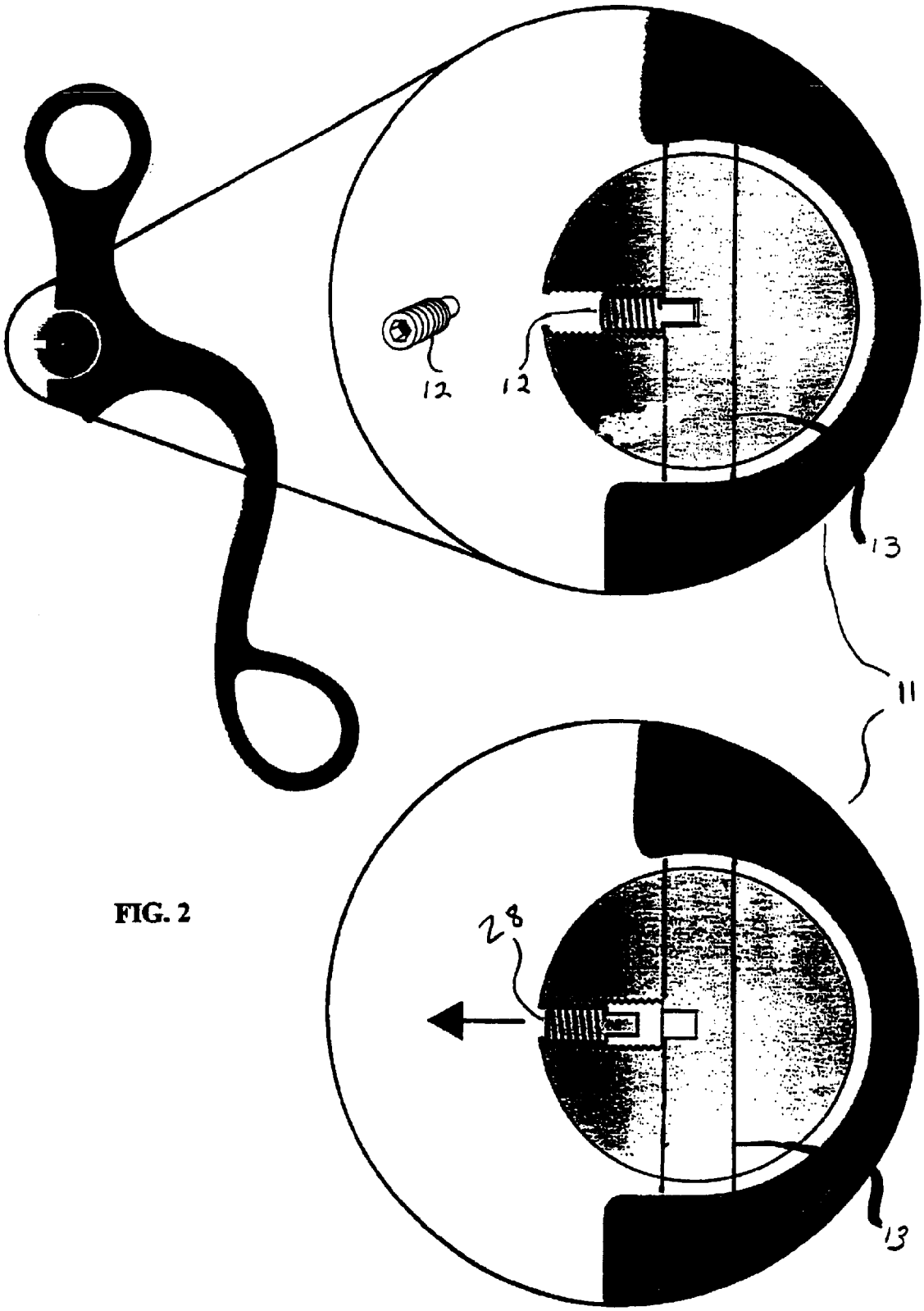
FIG. 2 shows an embodiment of the bit invention having shank pieces with a locking and unlocking mechanism.
Figure 3:
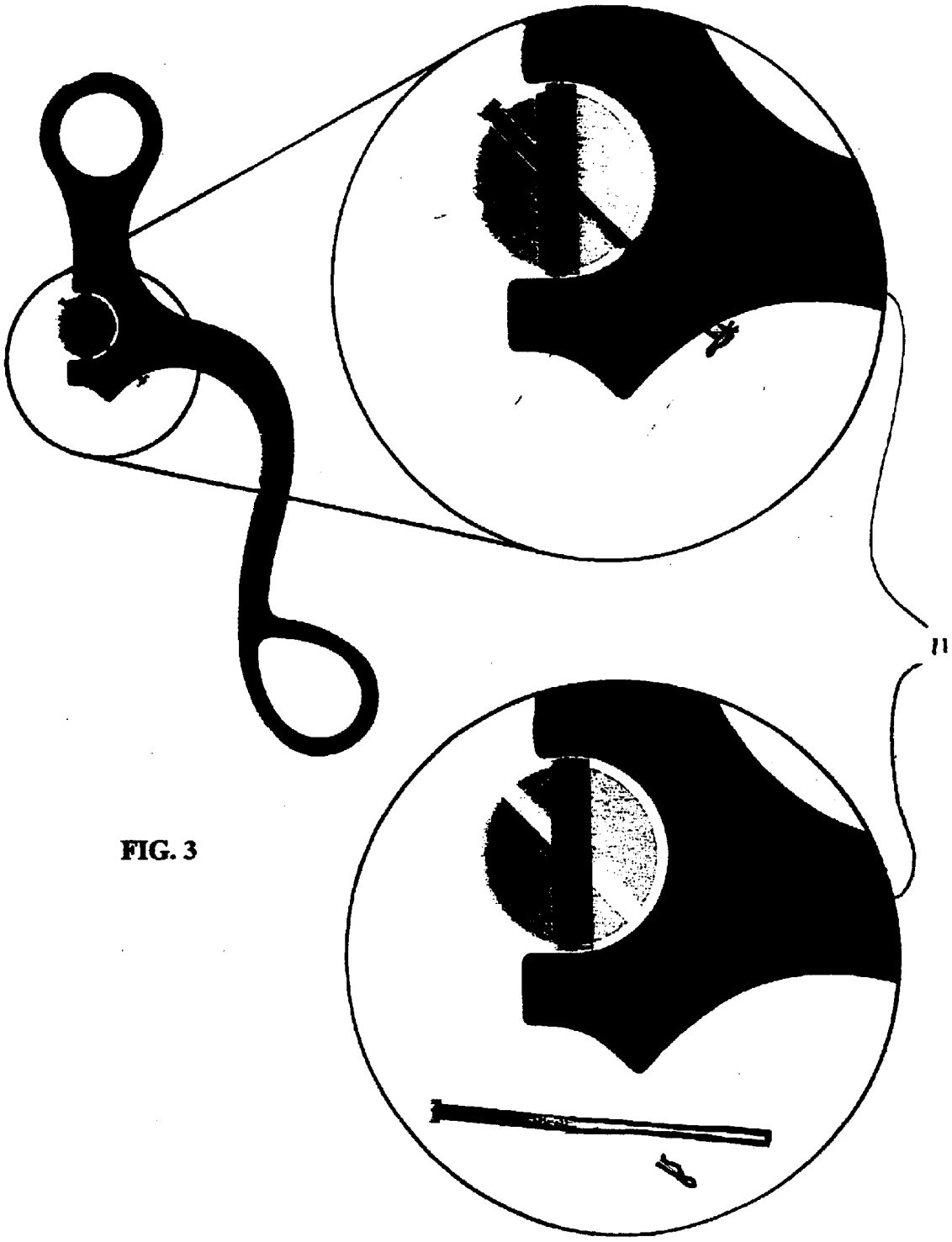
FIG. 3 shows another embodiment of the bit invention having shank pieces with a locking and unlocking mechanism.
Figure 4:
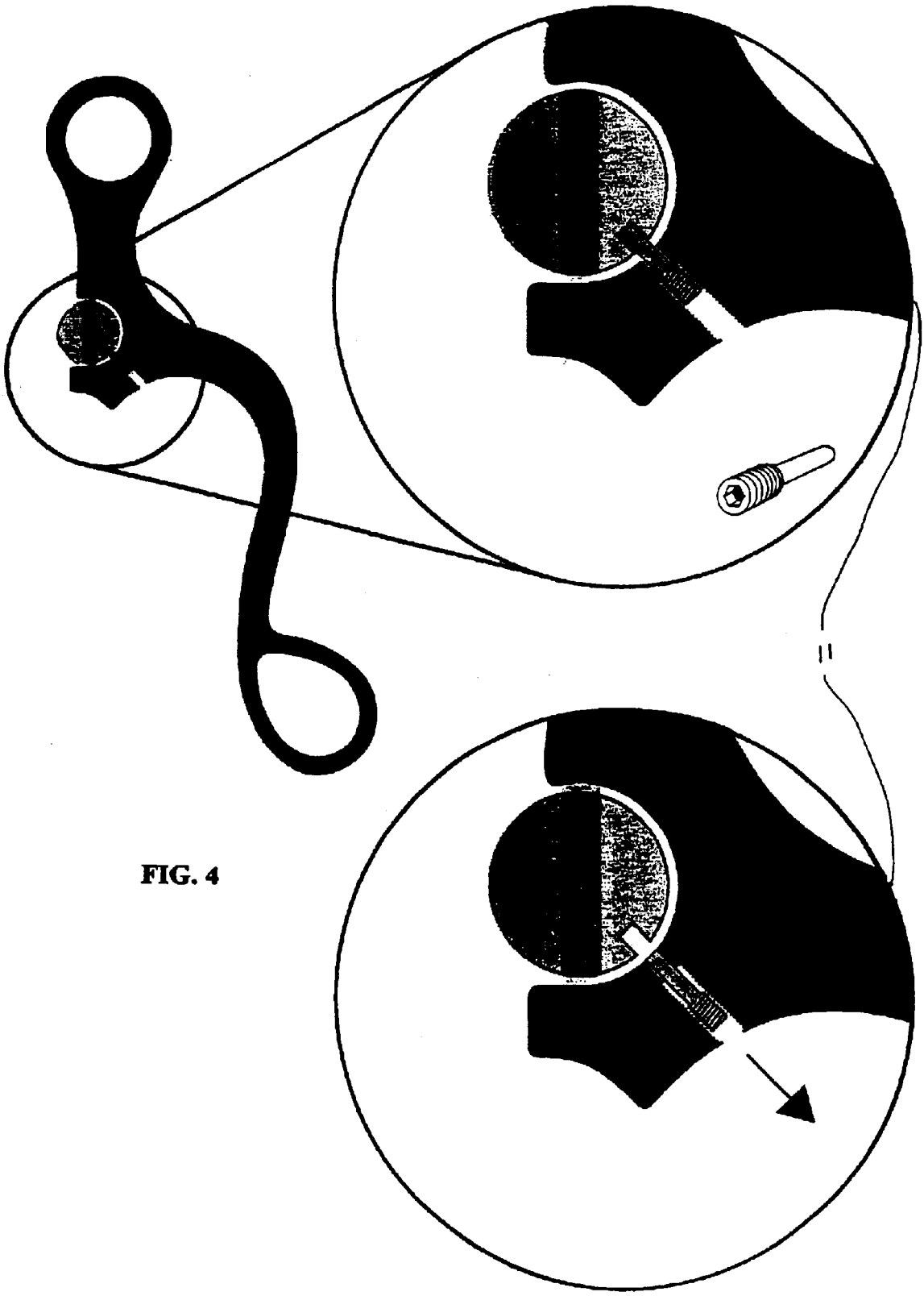
FIG. 4 shows another embodiment of the bit invention having shank pieces with a locking and unlocking mechanism.

Now referring primarily to FIG. 1, a bridle (1) comprising straps which adjustably fit around the animal's head (2), a bit (3) which may include shank pieces (4) on either side of a mouth piece (5) adapted to fit in the particular animal's mouth and extend over and atop its tongue that is responsive to the shank pieces (4). The shank pieces (4) can comprise a head stall ring member (8) a shank body (9) having selectably adjustable movement with respect to the outward ends of the mouthpiece (5) extending from the animal's mouth, and ring ends (7) that provide an attachment means for reins (6). The head stall ring member may also be adapted to receive a curb chain (10).

Now referring primarily to FIGS. 2–15. The shank (4) may be used with any suitable mouthpiece, including mouthpieces of a fixed construction, two or three part mouthpieces, interchangeable mouth piece bits, or the like coupled to shank post (13). Certain embodiments of the bit invention can comprise a locking mechanism (11) that can comprise an adjustable lock element (12) that can be adjusted to allow the shank to rotate freely about the longitudinal axis of the shank post (13) or can be adjusted to fix the rotation of the shank with respect to the shank post (13) (as shown by FIGS. 2, 3, 4, 7, 8, 11, and 12).

Alternately, certain embodiments of the invention can comprise a selectably adjustable limited travel mechanism (14) that can be adjusted to allow the shank to rotate freely about the longitudinal axis of the shank post (13) or can be adjusted to limit the rotational travel of the shank with respect to the shank post (13) (as shown by FIGS. 5, 6, 9, 10, 13, and 14).

In either case, the mechanism for locking/unlocking or limiting the rotational travel of the shank (4) about the shank post (13) can comprise numerous embodiments of hardware such as the various types of locking or adjustment screws shown in FIGS. 1, 2, 5, 6, 7, 9, 10, 11, 13, or 14, or can comprise the various types of locking pins shown in FIGS. 3, 4, 8, or 12.

Figure 5:
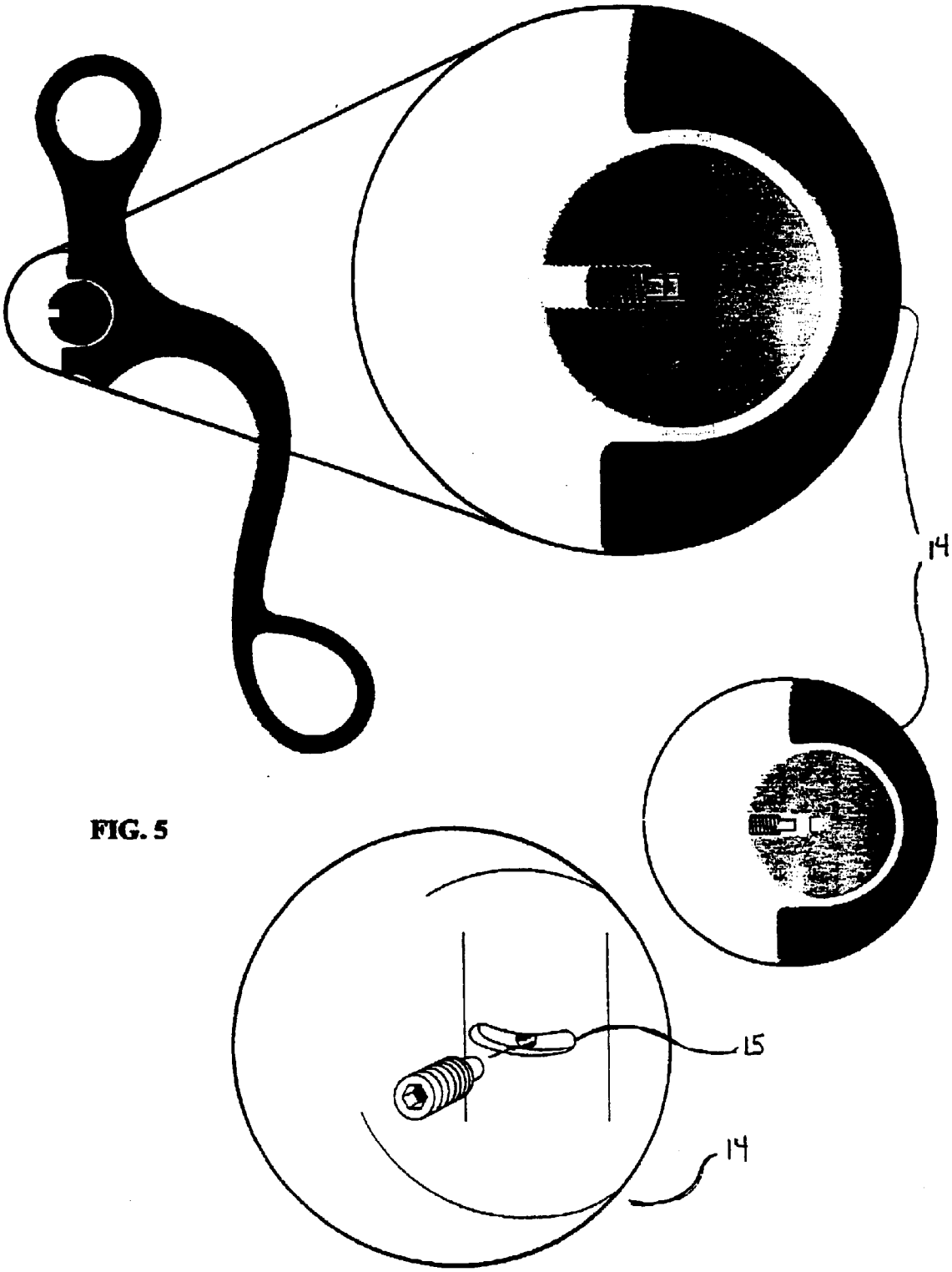
FIG. 5 shows another embodiment of the bit invention having shank pieces with a locking and unlocking mechanism that allows limited rotational travel.
Figure 6:
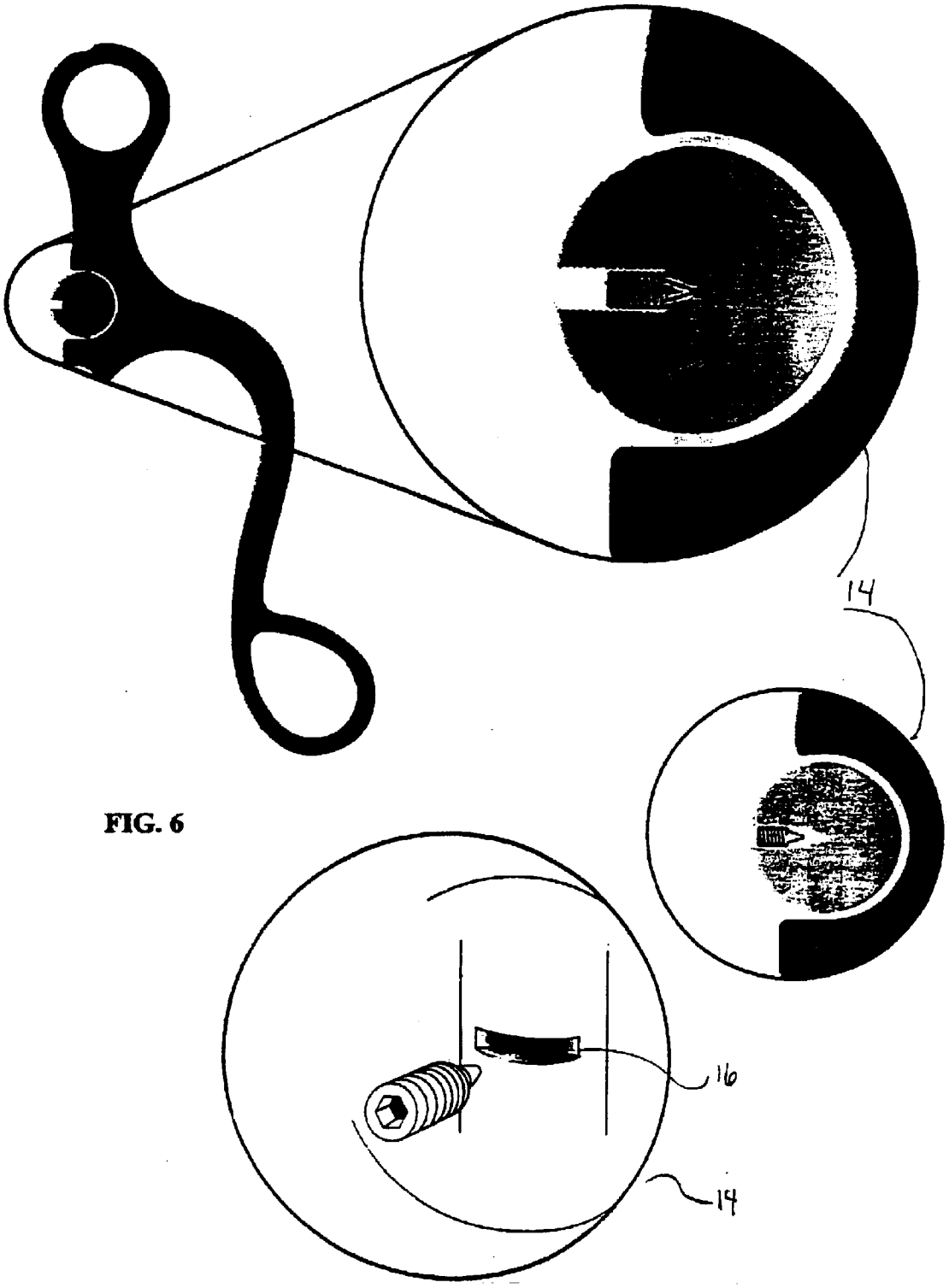
FIG. 6 shows another embodiment of the bit invention having shank pieces with a locking and unlocking mechanism that allows limited rotational travel.
Figure 7:
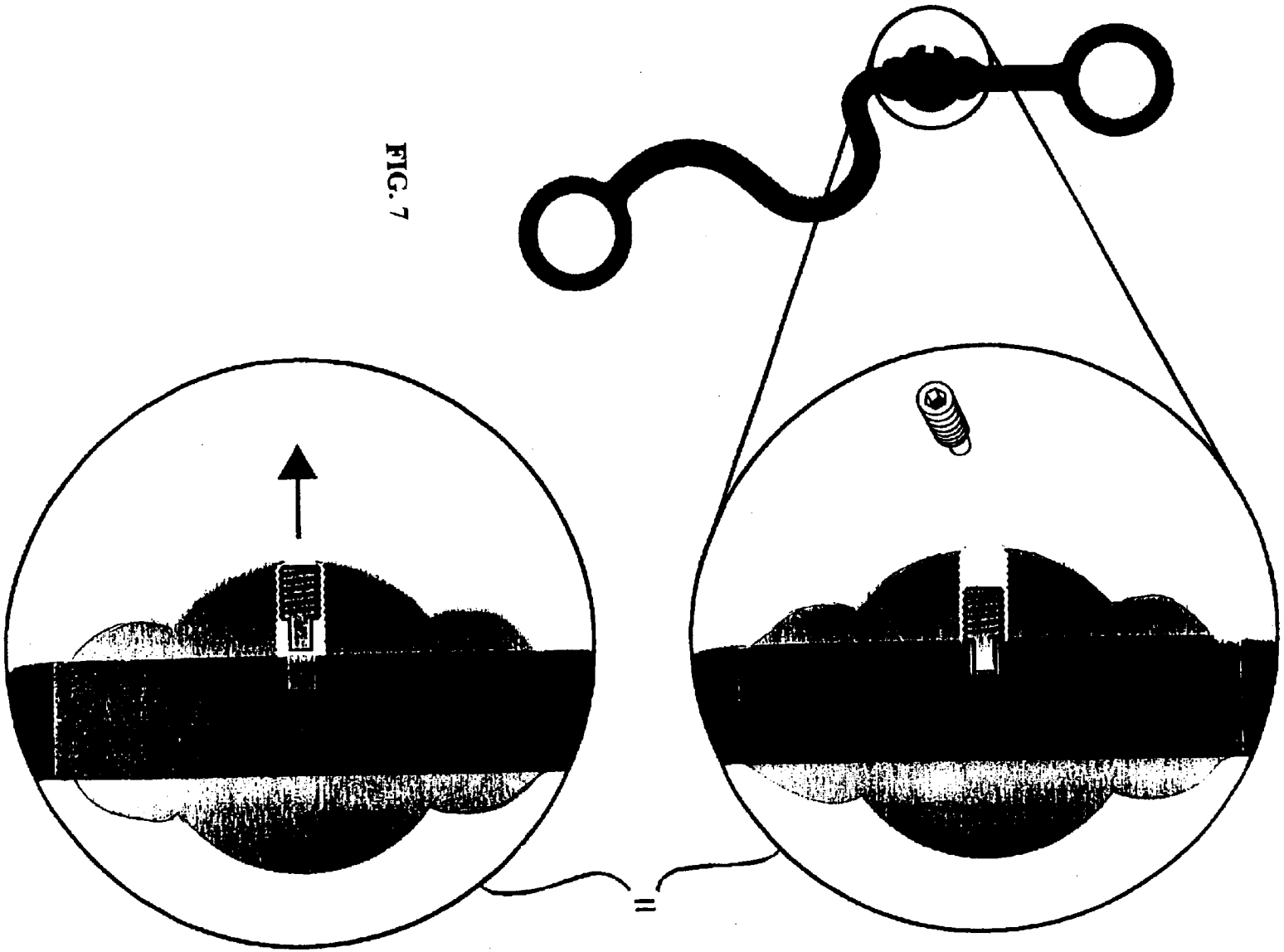
FIG. 7 shows another embodiment of the bit invention having shank pieces with a locking and unlocking mechanism.
Figure 8:
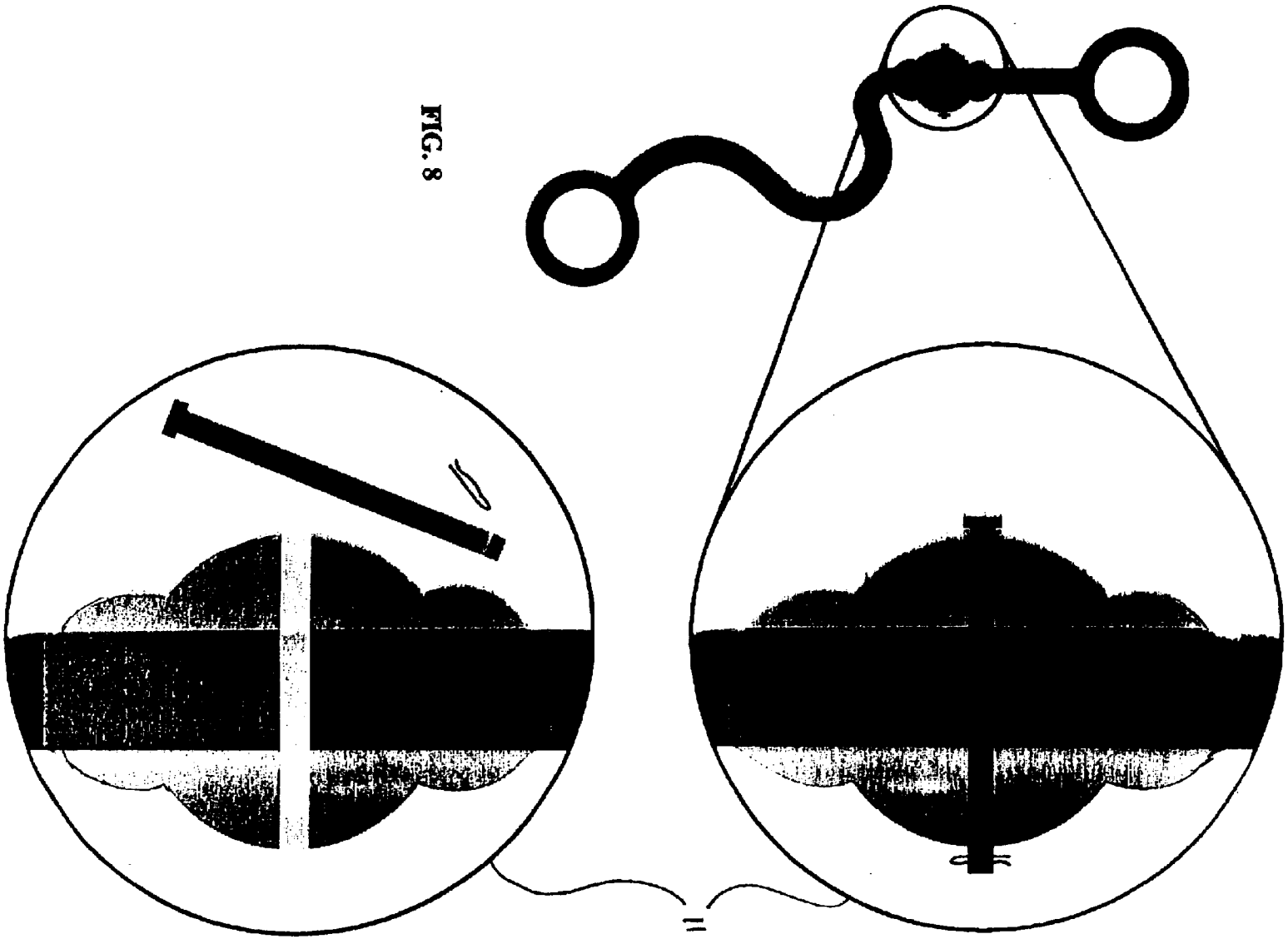
FIG. 8 shows another embodiment of the bit invention having shank pieces with a locking and unlocking mechanism.
Figure 9:
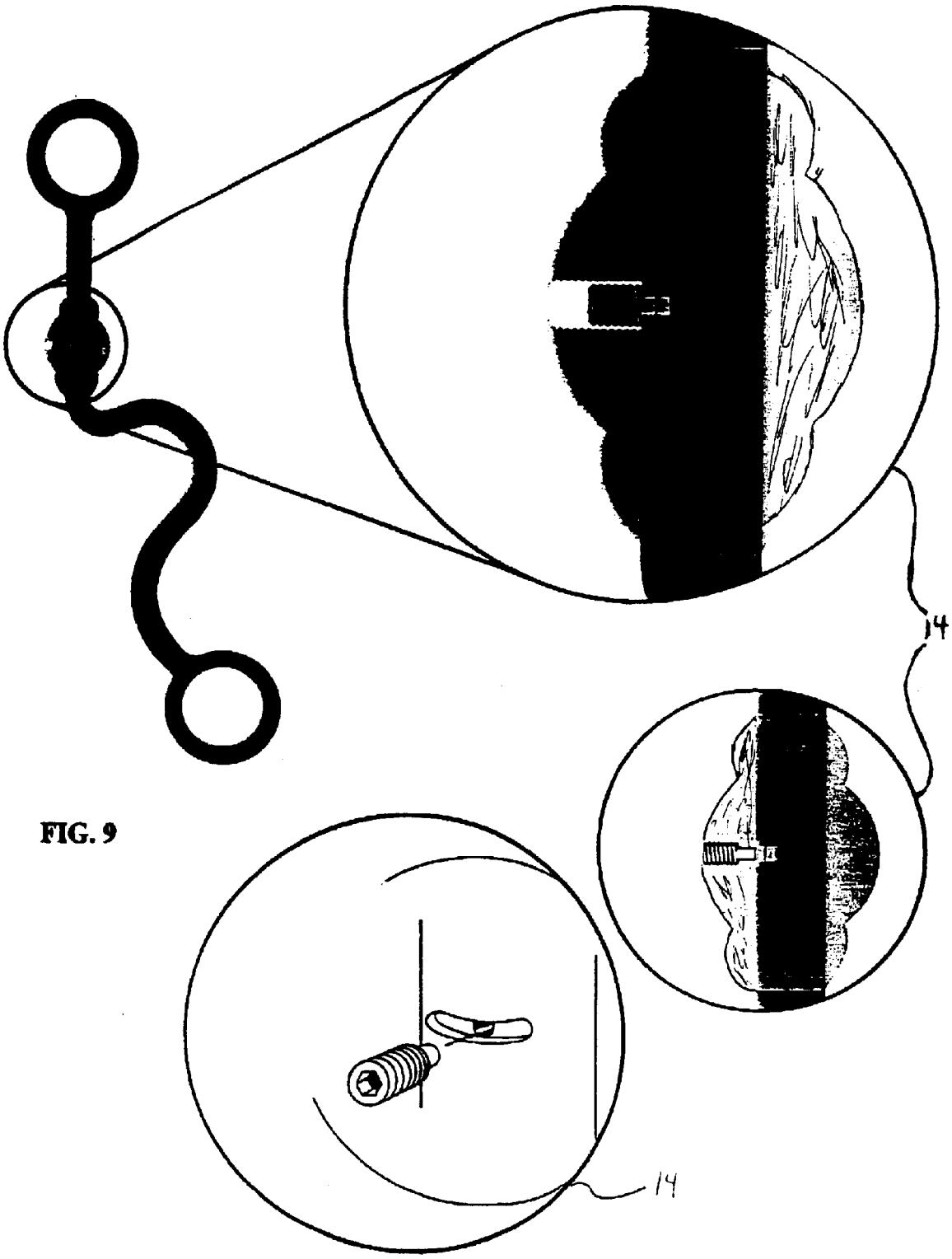
FIG. 9 shows another embodiment of the bit invention having shank pieces with a locking and unlocking mechanism that allows limited rotational travel.
Figure 10:
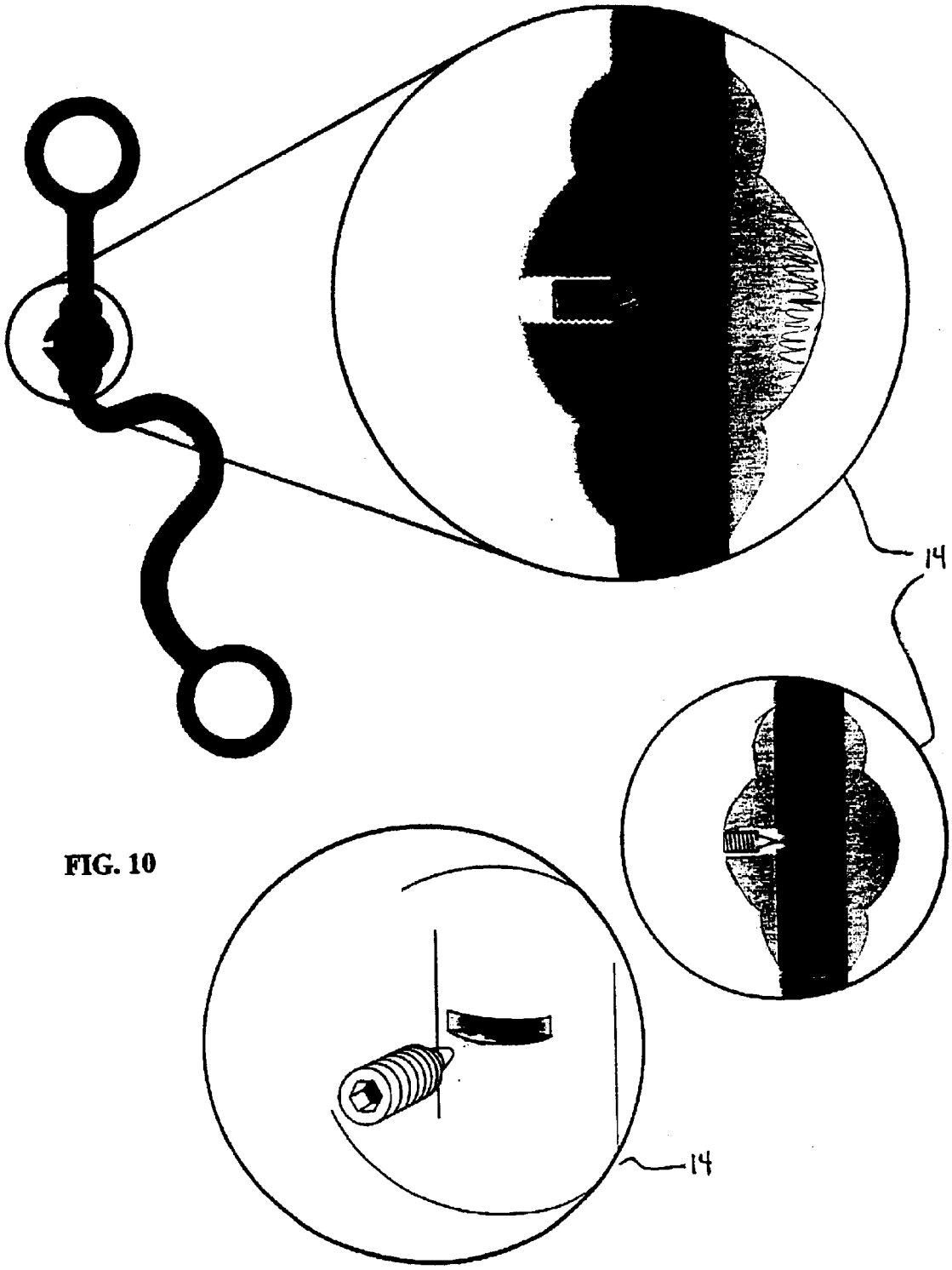
FIG. 10 shows another embodiment of the bit invention having shank pieces with a locking and unlocking mechanism that allows limited rotational travel.
Figure 11:
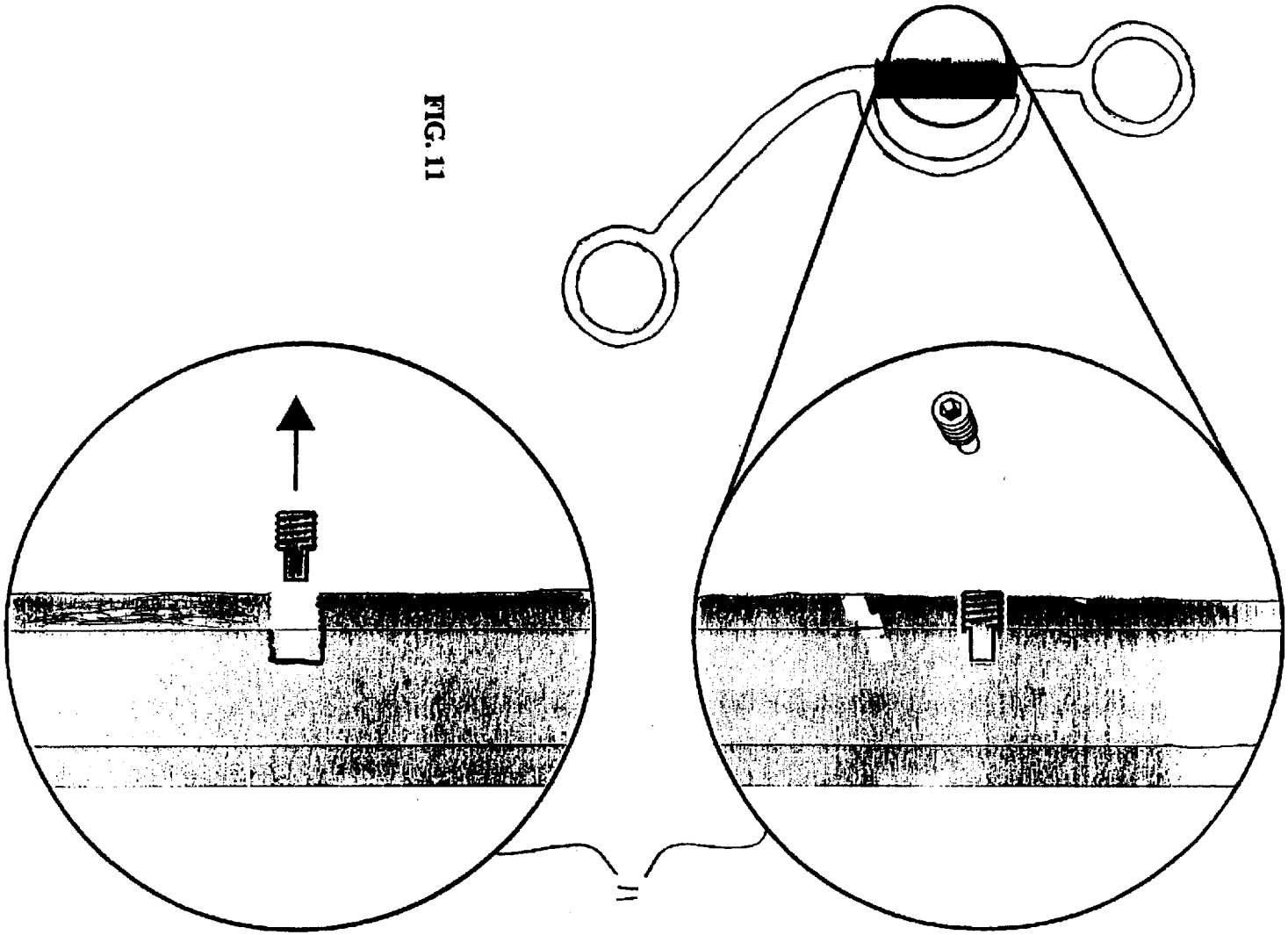
FIG. 11 shows another embodiment of the bit invention having shank pieces with a locking and unlocking mechanism.
Figure 12:
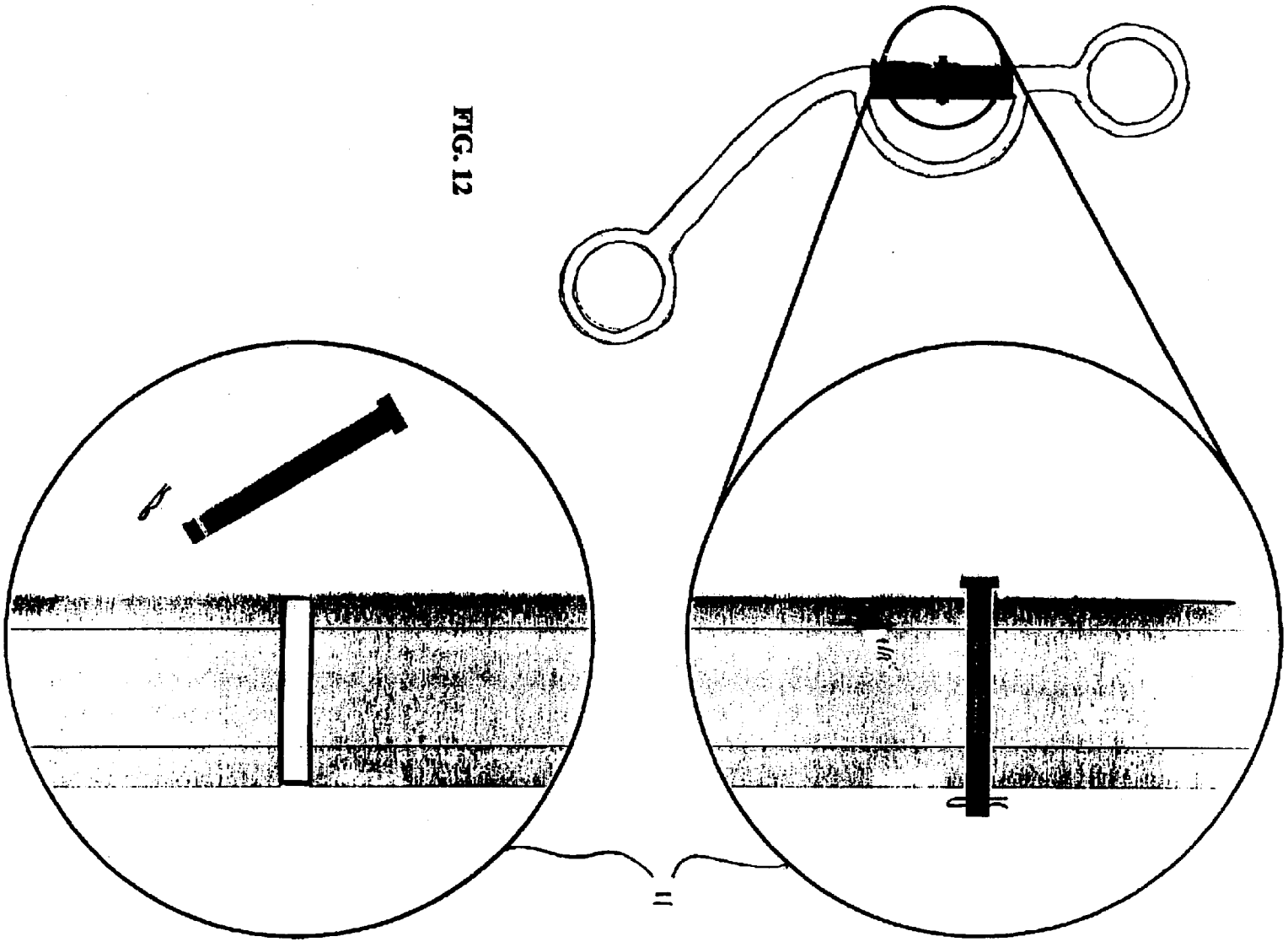
FIG. 12 shows another embodiment of the bit invention having shank pieces with a locking and unlocking mechanism.
Figure 13:
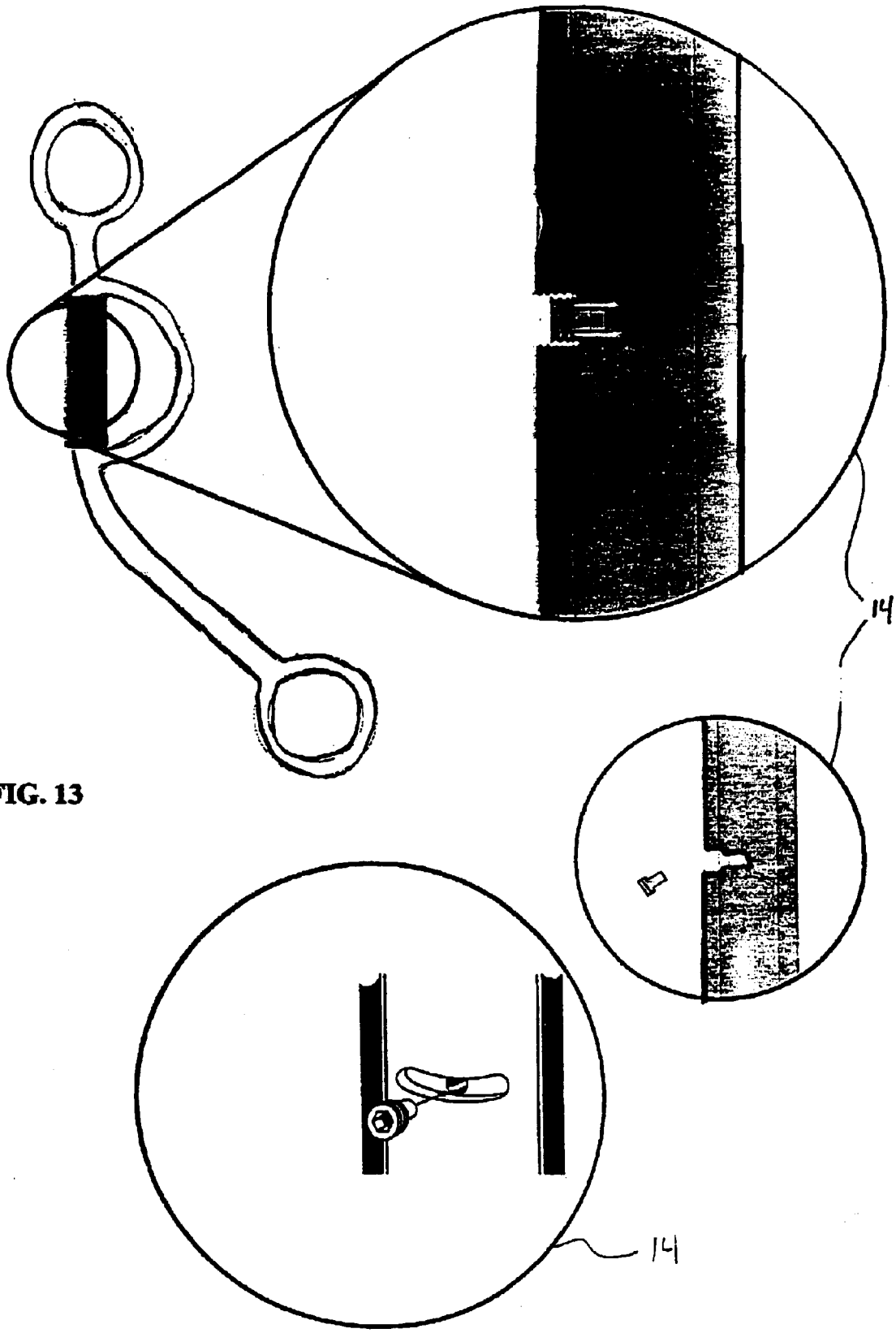
FIG. 13 shows another embodiment of the bit invention having shank pieces with a locking and unlocking mechanism that allows limited rotational travel.
Figure 14:
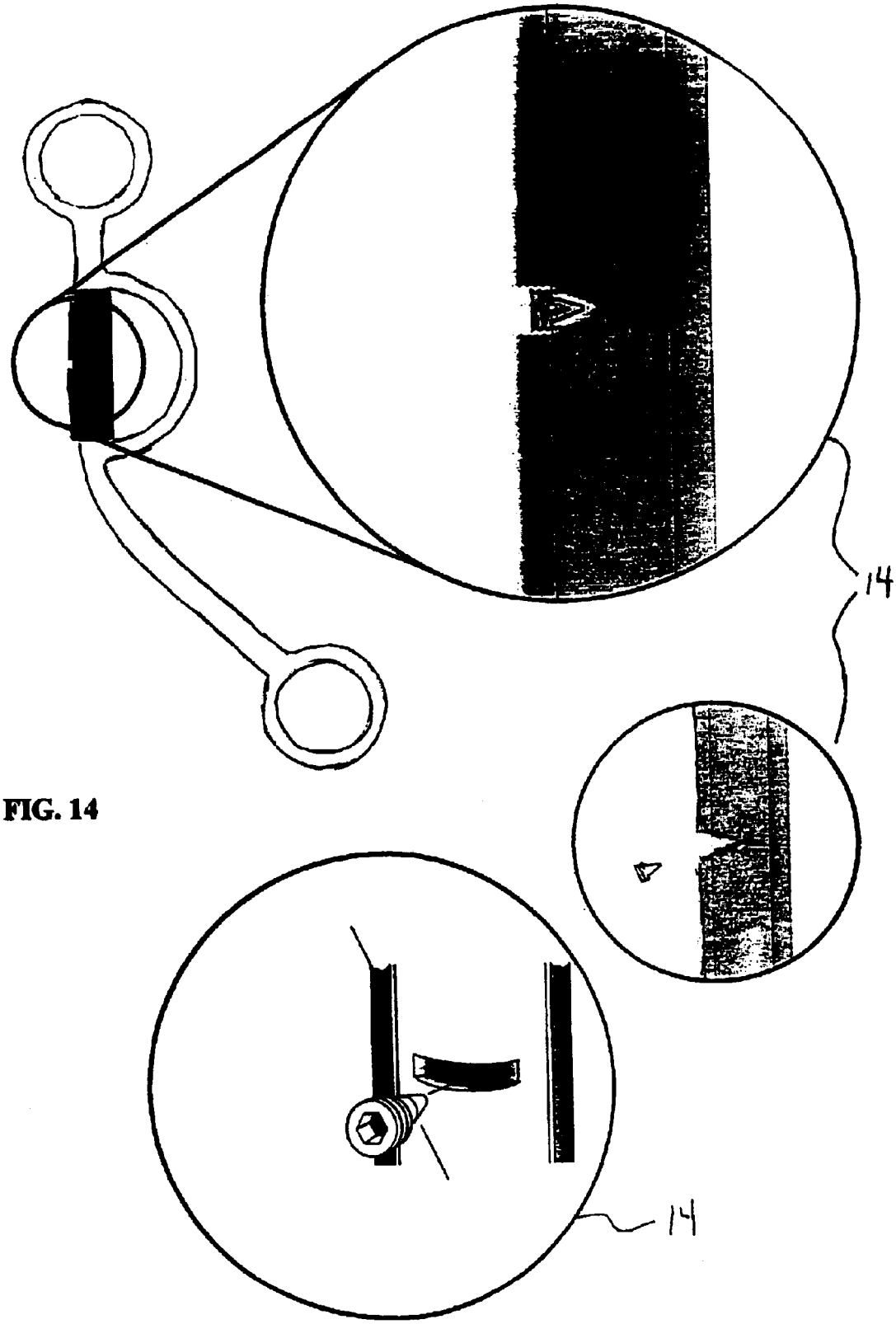
FIG. 14 shows another embodiment of the bit invention having shank pieces with a locking and unlocking mechanism that allows limited rotational travel.

As can be understood from the Figures, the rotational travel of the shank pieces (4) can be completely free about the shank post (13) or can be limited to a specific number of degrees of rotation about the shank post (13) depending on the configuration of the slot (15) (as illustrated by FIG. 5 or 13) machined into the shank post (13) or can be selectably adjustable about the shank post (13) by configuring an adjustable travel element (16) into the shank post (13). Depending on the application, the slot (15) or the adjustable travel element (16) can allow less or greater rotational travel about the shank post (13) or the adjustable travel element can be configured to allow fine or course adjustment of rotation travel about the shank post (13). Naturally, certain embodiments of the invention can include both a slot (15) and an adjustable travel element (16) to allow both factions to occur in the same bit (3).

Figure 15:
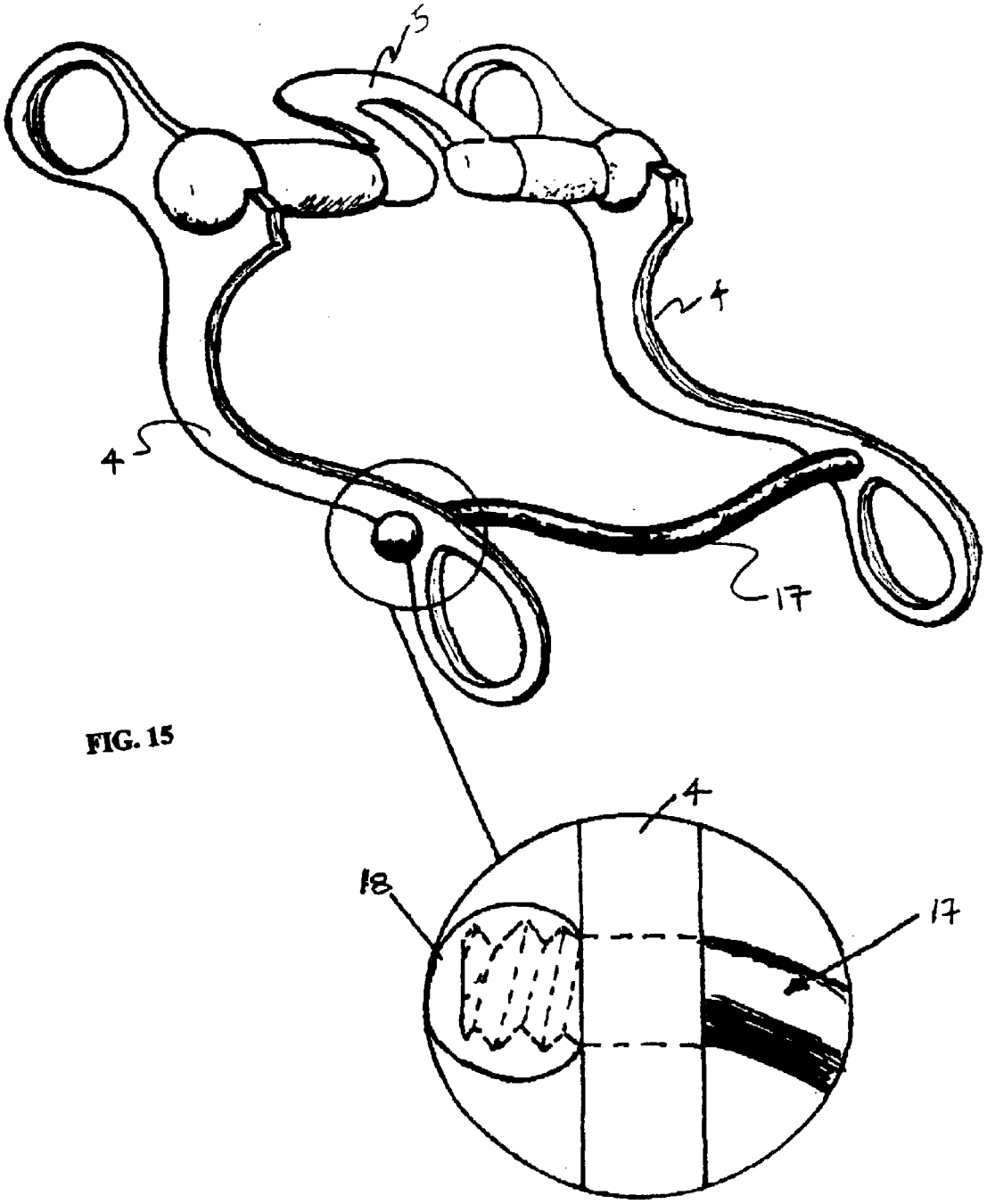
FIG. 15 shows another embodiment of the bit invention having a shank travel locking bar.

Now referring primarily to FIG. 15, an embodiment of the invention can comprise an alternative means of locking the travel of the shank pieces (4) with respect to the mouth piece (5). A shank travel locking bar (17) can be coupled to both shank pieces (4) by hardware means (18). The hardware means can be a spirally threaded nut or cap that mates with the spirally threaded ends of the shank travel locking bar (17) as shown by FIG. 15. The hardware means need only make the ends of the shank travel locking bar (17) responsive to the shank pieces (4). By adjusting the hardware means against the shank pieces more or less travel can be established between the mouth piece (5) and the shank pieces (4).

Figure 16:
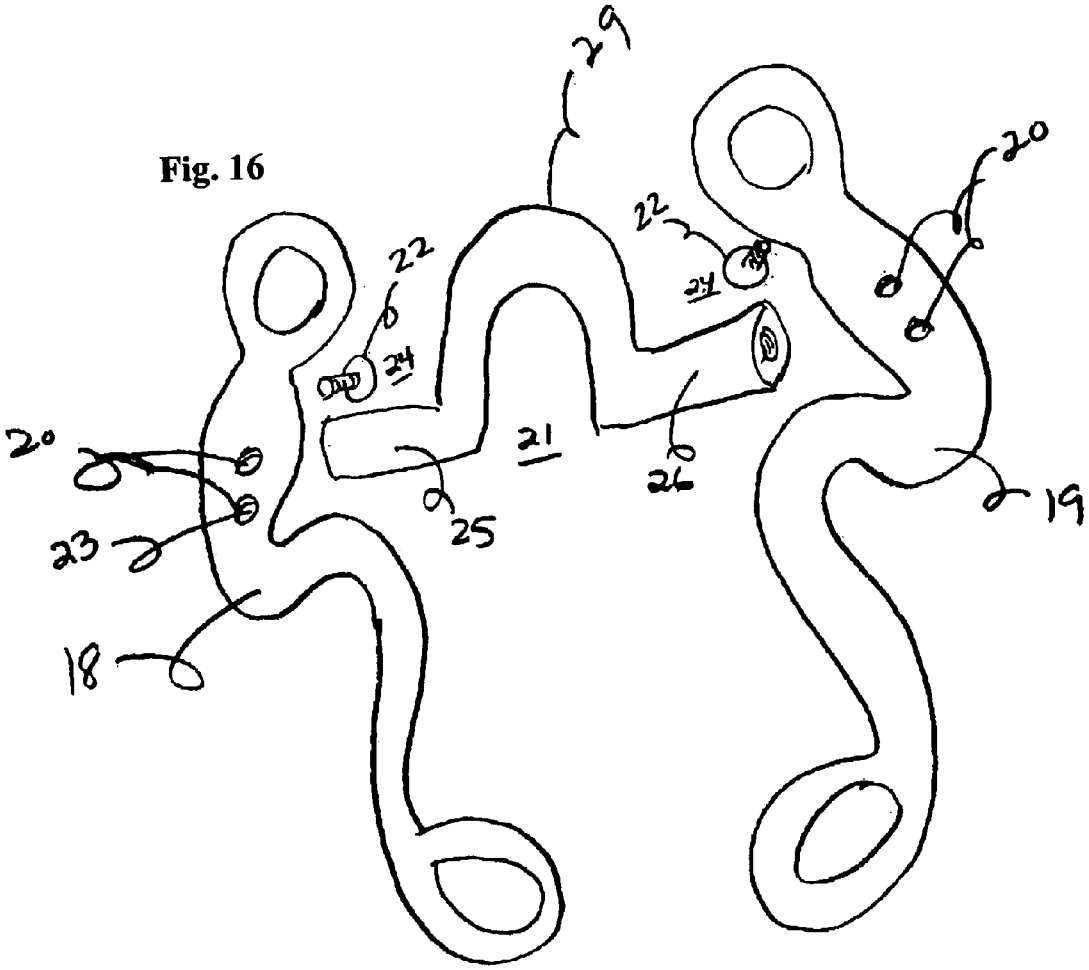
FIG. 16 shows another embodiment of the bit invention having a mouthpiece which can be adjusted to different height settings.

Now referring primarily to FIG. 16, an embodiment of the invention can comprise an adjustable bit having a first shank piece (18) and a second shank piece (19). The first shank piece (18) and the second shank piece (19) can further provide mouth piece position adjustment elements (20). The mouth piece position adjustment elements (20) allow a mouth piece (21), such as the mouth piece shown in FIG. 16, the various mouthpieces described above, or any mouth piece that can be made responsive to shank pieces, to have selectable positional engagement of the first shank piece and the second shank piece. As such, the mouthpiece (21) can be positioned as desired relative to the first shank piece (18) and the second shank piece (19). Once the desired position of the mouthpiece (21) is selected at least one releasable securement element (22) operates to maintain selected positional engagement the mouth piece (21) with the mouth piece position adjustment elements (20) so that the mouth piece (21) responds to movement of the shank pieces (18(19). Selectable positional engagement of the mouth piece (21) to the shank pieces (18)(19) allows the same bit to be used with different animals, whether the same or different species, or allows the same bit to be adjusted optimally for a single animal, or allows the same bit to be used for different riding styles or conditions, or allows different types of shank pieces and mouth pieces to be used in various combinations or permutations species.

Various embodiments of the mouth piece adjustment elements (20) are encompassed by the invention. A first non-limiting example can be the type of mouth piece adjustment elements shown in FIG. 16, which comprise a plurality of apertures or bores (23) disposed in each of the first shank piece (18) and the second shank piece (19). Each aperture or bore (23) communicates between the surfaces of the corresponding shank piece. The number or pattern, or both, of the plurality of apertures or bores can be selected to allow the mouth piece to be selectably positioned within the range of adjustment desired. With respect to, certain embodiments of the invention each of the plurality of aperture elements can provide selectable positioning within aperture periphery. For example, the aperture element (23) can have slotted configuration, or any configuration that allows the mouth piece (21) to have a range of selectable positions desired. In these embodiments, a single aperture can be sufficient to allow the desired range of selectable positioning of the mouth piece (21). These examples of mouth piece (21) adjustment elements is not intended to be exhaustive but rather are intended to be sufficient to show how to make and use the wide variety mouth piece adjustment elements that the invention encompasses.

Again various embodiments of releasable securement element (22) are encompassed by the invention. For example, the ends of the mouth piece (21) that engage the mouth piece adjustment elements (20) can be configured to accept mechanical hardware (24) that operably increases the frictional engagement between the mouth piece (21) and the shank pieces (18)(19). In some embodiments of the invention, the mechanical hardware (24) can comprise operably mated threads (24), such as a treaded bars (25)(26) of the mouth piece (21) to which the mated treads of a nut correspond, or can be threaded bore in the bars (25)(26) of the mouth piece (21) to which the mated threads of a bolt correspond. In other embodiments of the invention, the releasable securement (22) can comprise a locking member at either end of the mouth piece that by insertion or mating with the corresponding mouth piece adjustment elements locks the position of the mouth piece relative to the shank piece. One example would be a depressible bullet on the mouth piece that engages a corresponding catch on the mouthpiece adjustment element. Again, these examples are not intended to be exhaustive, but rather are intended to be sufficient to show how to make and use the wide variety of releasable securement encompassed by the invention.

As can be understood, from the description and figures, a method of adjusting a bit in accordance with the invention can comprise the steps of positioning a mouth piece (21) of the various configurations described above to engage with one of the numerous embodiments of corresponding mouth piece position elements (20) coupled to each of a pair of shank pieces (18)(19) and then engaging at least one releasable securement element (22) as described above to maintain the selected positional engagement of the mouthpiece (21) with the corresponding mouth piece position adjustment elements (20).

Figure 17:
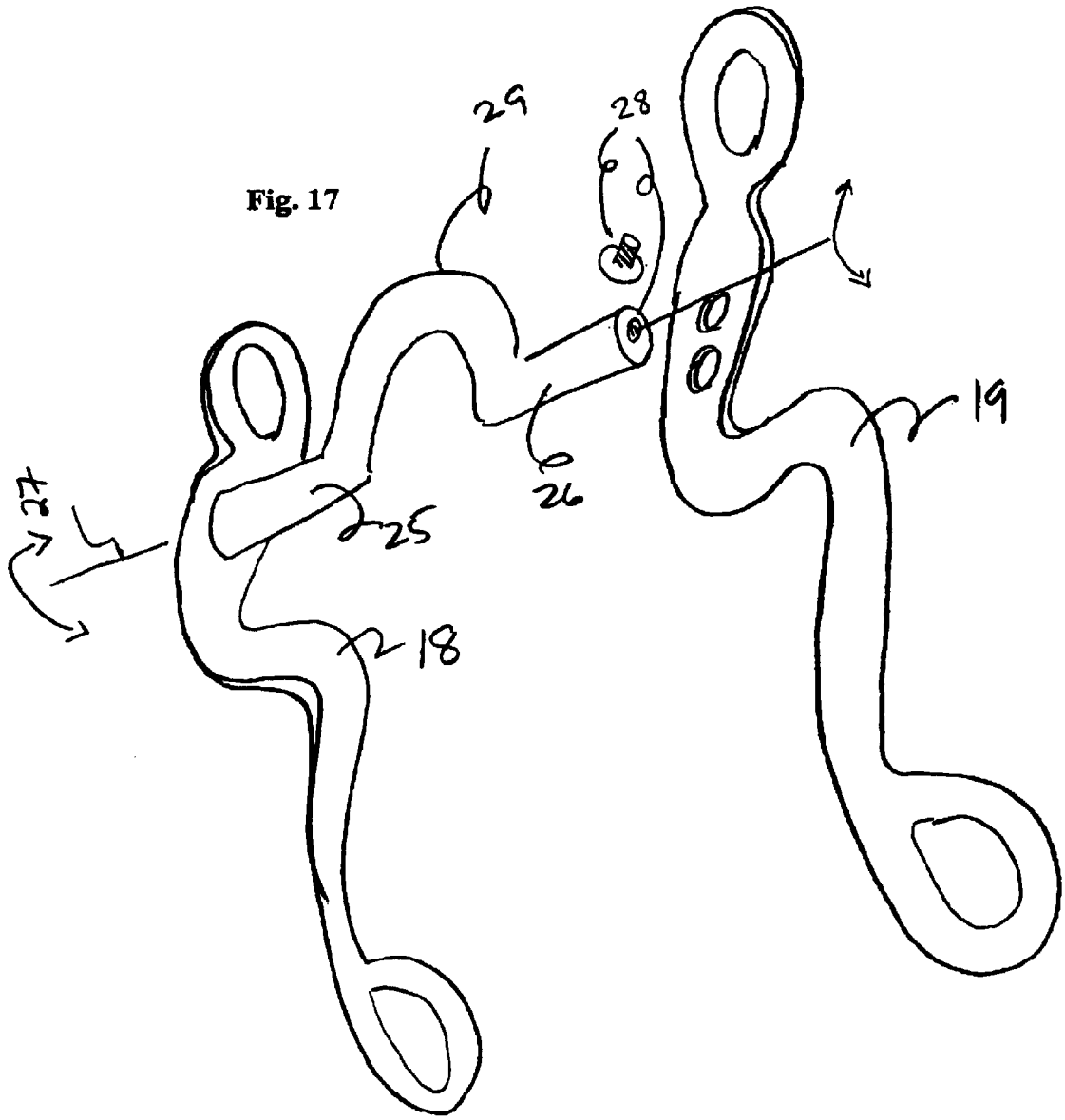
FIG. 17 shows an embodiment of the bit invention having a shank which can be adjusted into a stationary position relative to the mouthpiece.

Now referring primarily to FIG. 17, the invention can further comprise a rotation axis (27) about which the mouth piece (21) can be rotatably adjusted relative to the position of a first shank piece (18) and a second shank piece (19). Upon rotation of the mouth piece (21) to the desired position, at least one releasable rotation position securement element (28) can be operated to maintain the selected position of the mouth piece (21) against further rotation.

Variously configured mouth pieces (21), as described above, or which can be rotated relative to the shank pieces (18)(19), can be used in accordance with the invention. For example, a rigid mouth piece, having a first bar (25) a second bar (26) and a port (29) can be rotatably coupled to the shank pieces (18)(19) as shown in FIG. 17. This example is not intended to be exhaustive, but rather is intended to be sufficient to show how to make and use the wide variety of rotatable mouth pieces (21) encompassed by the invention.

The releasable rotation position securement element (28) can comprise (in at least one embodiment) a threaded bore in the first bar (25) and the second bar (26) operably mated with a threaded bolt having a compression element that engages the surface of the corresponding shank pieces (18)(19) to secure the mouth piece (21) against further rotation, as shown in FIG. 17. Certain embodiments of the releasable rotation position securement element (28) can further comprise a locking member and a catch member such as an operably mated depressible bullet element and catch element, which in some embodiments can further include a plurality of releasable catch elements over a range of rotation.

As such, a method of adjusting a bit can comprise the steps of positioning a mouth piece (21) which rotates between a pair of shank pieces (18)(l9) at a position and engaging at least one releasable rotation position securement element (28) to maintain position of the mouth piece (21) against rotation between the pair of shank pieces (18)(19). Disengaging the rotation releasable position securement element (28) allows positioning the of the mouth piece (21) to a second position between the shank pieces (18)(19) which by engaging the rotation releasable position securement element (28) can maintain the mouth piece (21) from further rotation.

The various embodiments of the adjustable bit invention described above including those embodiments of the invention which allow for selectable positioning of the mouth piece with respect to the shank pieces and allow for a rotatable coupling between the mouth piece and the shank pieces are further encompassed by the invention.

As can be easily understood from the foregoing, the basic concepts of the present invention may be embodied in a variety of ways. It involves a selectably adjustable bit and techniques of adjusting a bit. In this application, the selectably adjustable bit may be disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this United States non-provisional patent application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims which will be included in a full patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for the full patent application. It should be understood that such language changes and broad claiming will be accomplished when the applicant later (filed by the required deadline) seeks a patent filing based on this provisional filing. The subsequently filed, full patent application will seek examination of as broad a base of claims as deemed within the applicant's right and will be designed to yield a patent covering numerous aspects of the invention both independently and as an overall system.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of "reins" should be understood to encompass disclosure of the act of "reining"—whether explicitly discussed or not—and, conversely, were there effectively disclosure of the act of "reining", such a disclosure should be understood to encompass disclosure of a "reins" and even a "means for reining" Such changes and alternative terms are to be understood to be explicitly included in the description.

Any acts of law, statutes, regulations, or rules mentioned in this application for patent; or patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to claim at least: i) an adjustable bit as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, and ix) methods and apparatuses substantially as described hereinbefore and with reference to any of the accompanying examples, and x) the various combinations and permutations of each of the elements disclosed.

Further, if or when used, the use of the transitional phrase "comprising: is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

I claim:

1. An adjustable bit, comprising:

a. a first shank piece;

b. a second shank piece, wherein said first shank piece and said second shank piece provide corresponding mouth piece position adjustment elements;

c. a mouth piece having selectable positional engagement with said corresponding mouth piece position adjustment elements of said first shank piece and said second shank piece; and d. a releasable securement element to maintain selected positional engagement of said mouth piece with said corresponding mouth piece position adjustment elements of said first shank piece and said second shank piece, wherein said corresponding mouth piece position adjustment elements comprise at least one corresponding pair of aperture elements with which said mouth piece engages, and wherein said at least one corresponding pair of aperture elements each have an aperture periphery which establish the range of selectable positional engagement of said mouth piece with said first shank piece and said second shank piece.

2. An adjustable bit as described in claim 1, wherein said corresponding mouth piece position adjustment elements comprise a plurality of corresponding pairs of aperture elements with which said mouth piece has selectable positional engagement.

3. An adjustable bit as described in claim 1, further comprising a rotational coupling between said mouth piece and said corresponding mouth piece position adjustment elements.

4. An adjustable bit as described in claim 3, further comprising a releasable rotation position securement element which operates to maintain position of said mouth piece against rotation.

5. An adjustable bit, comprising:

a. a first shank piece;

b. a second shank piece;

c. a mouth piece rotationally coupled between said first shank piece and said second shank piece; and d. at least one releasable rotation position securement element operable to maintain a desired position of said mouth piece against rotation.

6. An adjustable bit as described in claim 5, wherein said mouth piece is substantially rigid.

7. An adjustable bit as described in claim 6, wherein said rigid mouth piece includes:

a. a first bar;

b. a second bar; and c. a port connected between said first bar and said second bar.

8. An adjustable bit as described in claim 7 wherein said port is rotationally coupled with said first bar and said second bar.

9. An adjustable bit as described in claim 5, further comprising:

a. mouth piece position adjustment elements which provide selectable positional engagement of said mouth piece with said first shank piece and said second shank piece; and b. a releasable securement element to maintain selected positional engagement of said mouth piece with said mouth piece position adjustment elements of said first shank piece and said second shank piece.

10. An adjustable bit as described in claim 9, wherein said corresponding mouth piece position adjustment elements comprise at least one corresponding pair of aperture elements with which said mouth piece engages.

11. An adjustable bit as described in claim 10, wherein said at least one corresponding pair of aperture elements each have a aperture periphery which establish the range of selectable positional engagement of said mouth piece.

12. An adjustable bit as described in claim 11, wherein said corresponding mouth piece position adjustment elements comprise a plurality of corresponding pairs of aperture elements with which said mouth piece engages.

13. An adjustable bit as described in claim 5 wherein said at least one releasable rotation position securement element is also operable to maintain position of said mouth piece within a range of rotation.

14. An adjustable bit as described in claim 13 wherein said range of rotation is an adjustable range of rotation.

15. An adjustable bit as described in claim 5 wherein said mouth piece is rotationally coupled to allow rotation of said first shank piece about its longitudinal axis and of said second shank piece about its longitudinal axis.

16. An adjustable bit as described in claim 15 wherein each said longitudinal axis is defined by a shank post.

17. An adjustable bit as described in claim 5 wherein said mouth piece is rotationally coupled to allow rotation of said mouth piece about a mouth piece axis.

18. An adjustable bit as described in claim 5 wherein said at least one releasable rotation position securement element is two releasable rotation position securement elements.

19. A method of adjusting a bit, comprising the steps of:

a. positioning a mouth piece which rotates about a longitudinal axis of at least one shank piece of a pair of shank pieces; and b. engaging at least one releasable rotation position securement element to maintain position of said mouth piece against rotation about said longitudinal axis of said at least one shank piece.

20. A method of adjusting a bit as described in claim 19, wherein said pair of shank pieces are substantially rigid.

21. A method of adjusting a bit as described in claim 19, wherein said mouth piece is substantially rigid.

22. A method of adjusting a bit as described in claim 19, further comprising the steps of:

a. disengaging said at least one releasable rotation position securement element; and b. positioning said mouth piece by rotation to a second position.

23. A method of adjusting a bit as described in claim 19, further comprising the steps of:

a. positioning said mouth piece to engage with corresponding mouth piece position adjustment elements coupled to each of said shank pieces; and b. engaging securement elements to maintain selected positional engagement of said mouth piece with said corresponding mouth piece position adjustment elements.

24. A method of adjusting a bit as described in claim 23, wherein said step of positioning said mouth piece to engage with said corresponding mouth piece position adjustment elements coupled to said shank pieces comprises positioning said mouth piece with a corresponding one of a plurality of aperture elements of each shank piece of said pair of shank pieces.

25. A method of adjusting a bit as described in claim 23, wherein said step of positioning said mouth piece to engage with said corresponding mouth piece position adjustment elements coupled to said shank pieces comprises positioning said mouth piece within the range of selectable positional engagement established by the periphery of an aperture element of each shank piece.

26. A method of adjusting a bit as described in claim 19 wherein said mouth piece rotates within a range of rotation.

27. A method of adjusting a bit as described in claim 26 wherein said range of rotation is an adjustable range of rotation.

28. A method of adjusting a bit as described in claim 19 wherein said mouth piece rotates about a longitudinal axis of each shank piece of said pair of shank pieces.

29. A method of adjusting a bit as described in claim 19 wherein the longitudinal axis of each shank piece is defined by a shank post.

30. A method of adjusting a bit as described in claim 19 wherein said mouth piece also rotates about a mouth piece axis, and further comprising the steps of:

positioning said mouth piece at a desired angular position; and engaging at least one additional releasable rotation position securement element to maintain said mouth piece at said desired angular position against rotation.

31. A method of adjusting a bit as described in claim 19 wherein said mouth piece has a port that rotates between a first bar and a second bar.

32. An adjustable bit, comprising:

a. a first shank piece having a longitudinal axis;

b. a second shank piece having a longitudinal axis;

c. a mouth piece rotationally coupled with said first shank piece such that said first shank piece is rotatable about its longitudinal axis; and d. a first locking mechanism which is operable to maintain position of said first shank piece against rotation about its longitudinal axis.

33. An adjustable bit as described in claim 32 wherein said first locking mechanism comprises an adjustable lock element.

34. An adjustable bit as described in claim 32 wherein said first shank piece rotatable about its longitudinal axis is rotatable within a range of rotation.

35. An adjustable bit as described in claim 34 wherein said range of rotation is an adjustable range of rotation.

36. An adjustable bit as described in claim 32 wherein said mouth piece is also rotationally coupled with said second shank piece such that said second shank piece is rotatable about its longitudinal axis, and wherein said apparatus further comprises a second locking mechanism which is operable to maintain position of said second shank piece against rotation about its longitudinal axis.

37. An adjustable bit as described in claim 32 wherein said second locking mechanism is an adjustable lock element.

38. A method of adjusting a bit, comprising the steps of:

a. positioning at a desired first angular position a mouth piece which rotates about a mouth piece axis, and b. engaging at least one releasable rotation position securement element to maintain said first desired angular position of said mouth piece against rotation about said mouth piece axis, wherein said mouth piece is rotationally coupled with at least one shank piece of a pair of shank pieces.

39. A method of adjusting a bit as described in claim 38, further comprising the steps of:

a. disengaging said at least one releasable rotation position securement element which maintains position of said mouth piece against rotation; and b. positioning said mouth piece by rotation to a second position.

40. A method of adjusting a bit as described in claim 38, further comprising the steps of:

a. positioning said mouth piece to engage with corresponding mouth piece position adjustment elements coupled to each of said shank pieces; and b. engaging securement elements to maintain selected positional engagement of said mouth piece with said corresponding mouth piece position adjustment elements.

41. A method of adjusting a bit as described in claim 40, wherein said step of positioning said mouth piece to engage with said corresponding mouth piece position adjustment elements coupled to said shank pieces comprises positioning said mouth piece with a corresponding one of a plurality of aperture elements of each shank piece of said pair of shank pieces.

42. A method of adjusting a bit as described in claim 40, wherein said step of positioning said mouth piece to engage with said corresponding mouth piece position adjustment elements coupled to said shank pieces comprises positioning said mouth piece within the range of selectable positional engagement established by the periphery of an aperture element of each shank piece.

* * * * *